US009728355B2

(12) United States Patent
Chu

(10) Patent No.: US 9,728,355 B2
(45) Date of Patent: Aug. 8, 2017

(54) ROTARY ENCODER SWITCH

(71) Applicant: Ching-Hsiung Chu, Taipei (TW)

(72) Inventor: Ching-Hsiung Chu, Taipei (TW)

( * ) Notice: Subject to any disclaimer, the term of this patent is extended or adjusted under 35 U.S.C. 154(b) by 101 days.

(21) Appl. No.: 14/564,096

(22) Filed: Dec. 9, 2014

(65) Prior Publication Data

US 2015/0187521 A1 Jul. 2, 2015

(30) Foreign Application Priority Data

Dec. 31, 2013 (TW) ..... 102149343 A

(51) Int. Cl.

| | |
|---|---|
| ***H01H 9/00*** | (2006.01) |
| ***H01H 19/02*** | (2006.01) |
| ***H01H 19/11*** | (2006.01) |
| *H01H 19/06* | (2006.01) |

(52) U.S. Cl.

CPC ..... *H01H 19/025* (2013.01); *H01H 19/115* (2013.01); *H01H 19/06* (2013.01); *H01H 2221/01* (2013.01); *H01H 2221/07* (2013.01)

(58) Field of Classification Search

CPC H01H 9/00; H01H 19/14; H01H 3/00; H01H 3/02; H01H 3/08; H01H 2003/02; H01H 2003/12; H01H 2201/004; H01H 2205/00; H01H 2205/002; H01H 2205/004; H01H 2221/01; H01H 2223/01; H01H 2223/012; H01H 2223/028; H01H 2231/012; H01H 2231/016; H01H 19/02; H01H 1/00; H01H 1/06; H01H 3/54; H01H 13/00; H01H 13/14; H01H 13/22; H01H 13/26; H01H 13/50; H01H 19/025; H01H 19/115; H01H 19/06; H01H 2221/07

USPC .. 200/4, 336, 329, 179, 19.03–19.05, 19.07, 200/19.08, 19.18–19.19, 36, 35 H, 316, 200/521, 11 R, 5 E, 13, 14, 11 C, 296, 200/564

See application file for complete search history.

(56) References Cited

U.S. PATENT DOCUMENTS

| | | | | |
|---|---|---|---|---|
| 5,581,058 A * | 12/1996 | Javery | B60Q 1/1476 | 200/11 G |
| 6,570,105 B1 * | 5/2003 | Sallam | H01H 25/06 | 200/1 R |
| 7,926,964 B2 * | 4/2011 | Claprood | G05G 1/105 | 362/23.01 |
| 2002/0023826 A1 * | 2/2002 | Miwa | H01H 25/065 | 200/4 |
| 2013/0032456 A1 * | 2/2013 | Nakajima | H01H 19/005 | 200/336 |

* cited by examiner

*Primary Examiner* — Anthony R Jimenez

(57) ABSTRACT

A rotary encoder switch includes a cover cap, a fixing sleeve, a first base board, an actuating device, and a second base board disposed under the actuating device. The actuating device includes a base seat and a rotary element rotatably connected to the base seat and mounted to the cover cap. The first base board is disposed on the actuating device and has multiple first lighting elements. The rotary element is rotatable in conjunction with rotation of the cover cap so as to generate encoding signals according to each rotary position of the cover cap for controlling functions of an applied product. The first lighting elements are capable of emitting light in sequence subject to the rotation of the cover cap, while the light being emitted is permeable to the cover cap for users to easily recognize the exact rotary position of the cover cap.

6 Claims, 7 Drawing Sheets

ROTARY ENCODER SWITCH

BACKGROUND OF THE INVENTION

1. Field of the Invention

The present invention relates to a switch, and more particularly to a rotary encoder switch having both mechanical and encoding structure and being capable of continuously rotating to provide multistage switches with indications of each stage.

2. Related Art

Generally, electronic products are provided with switches for switching on/off or controlling functions thereof. There are numerous types of switches that are mainly designed to control functions of products being applied to. For instance, controlling rotational speed of a fan, blowing velocity or setting temperature of an air conditioner, brightness of a lamp, or strength of signals of a radio.

A traditional mechanical rotary switch is known to consist of mechanical elements including a main body and a knob pivotally connected to the main body for being rotated, where rotary positioning of the knob is achieved by engagement of a tooth-shaped structure and a metal flexible plate. However, the metal flexible plate is a sort of cantilever structure which tends to produce material fatigue after use for a period of time and thus resulting in ineffective engagement with the tooth-shaped structure. Besides, one end of the flexible plate of the cantilever structure is usually soldered to a casing, while the other end is used to engage the tooth-shaped structure. As a result of frequent engagement, the end of the flexible plate being soldered is easily to be pulled out of the casing, or the flexible plate tends to be deformed thereby. Moreover, unlike dip switches, knife switches, or button switches, a main purpose of rotary switches is to pivotally rotate to achieve multistage switches for controlling functions of an applied product. For instance, regulating brightness or volume of sound. However, a traditional mechanical rotary switch is merely allowed to provide a certain number of stages for being switched, inasmuch as the number of stages allowed to be reached is limited within a single rotation of the knob. That is, when the knob is being rotated over more than one cycle, no more stages will be reached and thus no more functions will be performed. Therefore, fine performance of applied products cannot be performed due to limited control of switches.

In addition to the above-mentioned drawbacks, traditional rotary switches are not provided with indicator for indicating where rotary positioning is reached. Consequently, users cannot recognize which stage is being reached and thus has no reference position on the knob to be relied on for rotating in a desired position, particularly in a dim place.

SUMMARY OF THE INVENTION

Accordingly, an object of the present invention is to provide a rotary encoder switch having a structure of indicating rotary position of multistage switches and having a simple structure for improving waterproof ability.

Another object of the present invention is provide a rotary encoder switch being capable of continuously rotating multiple cycles to generate different encoding signals so as to enable a decent performance of an applied.

To achieve the above objects, the rotary encoder switch comprises a cover cap made of light permeable material, comprising a display face, a covering wall extending downward from peripheral edges of the display face, and a sleeve body penetrating the display face to extend downward. An actuating device comprises a base seat and a rotary element rotatably connected to the base seat and mounted into the sleeve body a first base board having a through hole and multiple first lighting elements arranged around the through hole and facing the display face of the cover cap, the through hole passing through the rotary element to be located on the base seat. A second base board disposed under the actuating device and having a plurality of terminal holes and conducting terminals electrically connected to a printed circuit board of an applied product; and a plurality of connecting terminals for connecting the first base board and the second base board, ends of the connecting terminals respectively passing through the plurality of terminal holes to electrically connect the printed circuit board of the applied product.

With the above-mentioned structure, the rotary element of the actuating device is rotatable in conjunction with rotation of the cover cap so as to produce encoding signals according to rotation position of the cover cap for controlling functions of the applied product, whereby the first lighting elements are capable of emitting light which is permeable to the cover cap in accordance with the rotation position and a rotation direction of the cover cap.

In one aspect of the present invention, the base seat of the actuating device further comprises a tube, a restraining portion, and a round track, the tube and the restraining portion respectively protruding from an upper surface of the base seat and spaced apart from each other, the round track formed around the tube and in between the tube and the restraining portion, the rotary element rotatably mounted to the tube and comprising an interfering tooth portion formed on peripheral sides thereof and disposed on the round track; and wherein the actuating device further comprises: a resilient element of which one end is coupled in the restraining portion, and another end extends out of the restraining portion in order to elastically engage the interfering portion; a shielding cover covering the interfering tooth portion and the restraining portion; a plurality of signal terminals disposed under and arranged around a bottom of the base seat, one end of each of the signal terminals stretching out of the base seat to form a soldering arm for being soldered to the second base board; a contact element provided under the base seat and above the plurality of signal terminals, and having multiple contact arms for electrically contacting the plurality of signal terminals; and a depressible apparatus disposed in the tube, and comprising a supporting seat, a button being light permeable and movably connected to the supporting seat in the rotary element and extending to the sleeve body of the cover cap for being depressed, and at least a second lighting element provided in the button and emitted at least by depressing the button; wherein the rotary element is pivotally rotatable about the tube on the round track, and the contact element and the interfering tooth portion are capable of rotating in conjunction with the rotary element whereby enabling the contact arms of the contact element to electrically contact the plurality of signal terminals along the round track so as to generate electrical signals which are then being transmitted to the printed circuit board for producing encoding signals, the resilient element being deformed and stretching backwards relative to rotation of the interfering tooth portion, and the resilient element returning to an original position to engage with the interfering tooth portion when the rotary element rotates in position.

In another aspect of the present invention, the sleeve body of the cover cap comprises multiple engaging ribs protruding from an inner surface thereof, an outer surface of the rotary element is provided with multiple engaging slots corresponding to and being engageable with the engaging ribs.

In another aspect of the present invention, the rotary encoder switch further comprises a fixing sleeve having a fixing wall, a mounting hole formed by the fixing wall, and an inner edge portion extending from a top of the fixing wall into the mounting hole, a bottom of the covering wall of the cover cap extends outward radially to form a retaining rim being retained by the inner edge portion.

The rotary encoder switch of the present invention utilizes the engagement of the resilient element and the interfering tooth portion of the rotary element to position the rotation of the rotary element driven by the cover cap, whereby effectively addressing the problem that a flexible plate of cantilever structure utilized in a traditional switch to position the rotary element tends to be damaged or disengaged after frequent use. Additionally, the maximum power supply to an applied product can be divided into a plurality of segment values by rotation of the cover cap, whereby generating an encoding signal which corresponds to a respective segment value according to each rotary position of the cover cap or the rotary element. Therefore, the rotary encoder switch is capable of reaching each one of the plurality of segment values by continuously rotating several cycles so as to enable a decent performance of an application product, whereby overcoming drawbacks of a traditional switch that is only capable of providing a limited number of switches and a poor performance. Furthermore, the first lighting elements in cooperation with the cover cap allow users to easily recognize where a rotary position is being reached.

DESCRIPTION OF THE PREFERRED EMBODIMENTS

A rotary encoder switch 1 of the present invention is applicable to electronic products, electric appliances or lighting devices for switching on or switching off or for controlling other functions thereof, such as, adjusting brightness of a light device, volume, wind velocity (e.g. a fan), or fire power (e.g. a gas stove) so as to precisely control an application product by multistage switches.

Figure 5:
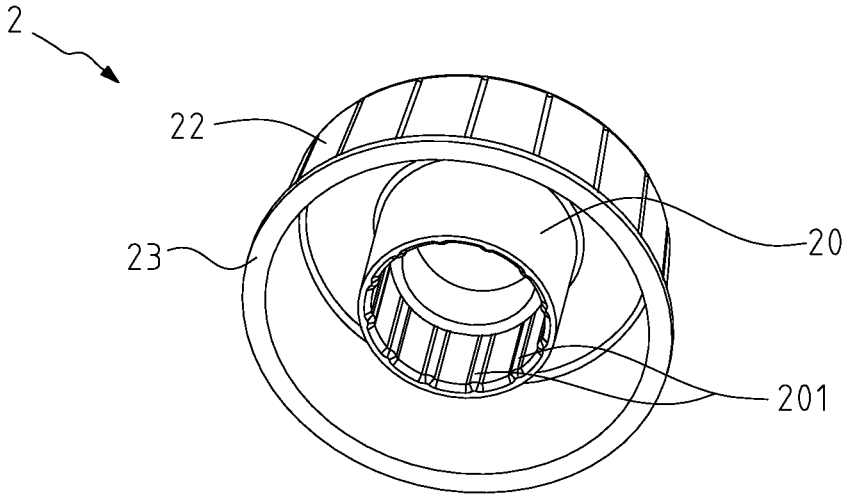
FIG. 5 is schematic bottom perspective view of a cap of the present invention.

Referring to FIGS. 1 to 6 illustrating a preferable embodiment of the present invention, the rotary encoder switch comprises a cover cap 2, a fixing sleeve 3, a first base board 4, an actuating device 5, and a second base board 8. The cover cap 2, made of light permeable material and having a round shape, comprises a display face 21, a covering wall 22 extending downward from peripheral edges of the display face 21, and a sleeve body 20 penetrating the display face 21 and extending downward. The sleeve body 20 of the cover cap 2 comprises multiple engaging ribs 201 protruding from an inner surface thereof (as shown in FIG. 5), wherein the multiple engaging ribs 201 longitudinally spaced apart from each other. The display face 21 and the covering wall 22 are capable of being provided with predetermined patterns by laser marking or printing according to practical application in order to cooperate with light emitted internally to create visual effect. Furthermore, a bottom of the covering wall 22 of the cover cap 2 extends outward radially to form a retaining rim 23.

The fixing sleeve 3 has a fixing wall 31, amounting hole 30 formed by the fixing wall 31, and an inner edge portion 32 extending from a top of the fixing wall 31 into the mounting hole 30. The fixing sleeve 3 is mounted to the cover cap 2 through the mounting hole 30, wherein the inner edge portion 32 is retained by the retaining rim 23 in a vertical direction. Moreover, the fixing wall 31 is provided with a plurality of fastening plates 522 for being fastened with an applied product (not shown). It is noted that in a practical application the rotary encoder switch 1 is not necessary to use with the fixing sleeve 3 and is allowed to be directly assembled with a printed circuit board (not shown) of an applied product by soldering.

Figure 6:
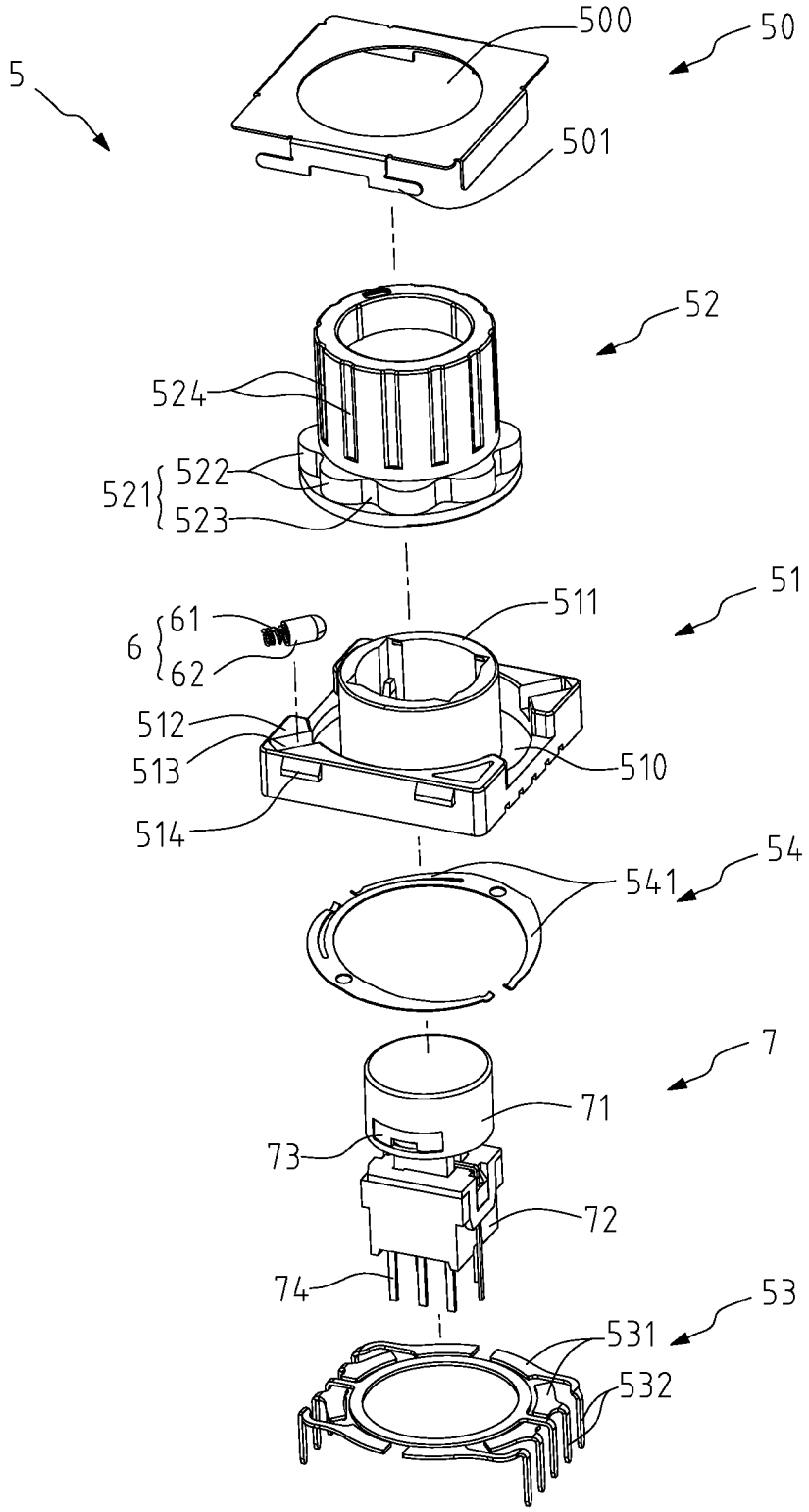
FIG. 6 is an exploded perspective view of an actuating device of the present invention.

The actuating device 5 comprises a shielding cover 50, a base seat 51, a resilient element 6, a rotary element 52 and a contact element 54 (as shown in FIG. 6). The rotary element 52 is rotatably connected to the base seat 51. The sleeve body 20 of the cover cap 2 comprises multiple engaging ribs 201 protruding from an inner surface thereof, and an outer surface of the rotary element 52 is provided with multiple engaging slots 524 corresponding to and being engageable with the engaging ribs 201, so that the rotary element 52 is mounted in the sleeve body 20 and is securely positioned with the engagement of the engaging slots 524 and the engaging ribs 201 in a horizontal direction, by which engagement the waterproof ability is also efficiently improved that outer water is not easily to leak into the first base board 4 and the second base board 8.

The first base board 4 is a printed circuit board and comprises a through hole 40 and multiple first lighting elements 41 arranged around the through hole 40 and facing the display face 21 of the cover cap 2. The through hole 40 passes through the rotary element 52 to be located on the base seat 51. In this embodiment, the first lighting elements 41 are light emitting diodes of which the number is 16. The first lighting elements 41 emit light subject to practical use, where the light being emitted is permeable to the display face 21 and the covering wall 22 to be seen from outside. Because the first base board 4 is disposed above the actuating device 5 and the second base board 8 and is near the display face 21, lighting effect of the multiple first lighting elements 41 is not to be weakened because of the distance between the cover cap 2 and the first base board 4. Additionally, the multiple first lighting elements 41 provided on the first base board 4 are beneficial to repair work, inasmuch as the first lighting elements 41 are capable of being repaired or replaced directly from the first base board 4 without damaging or affecting the second base board 8.

Figure 1:
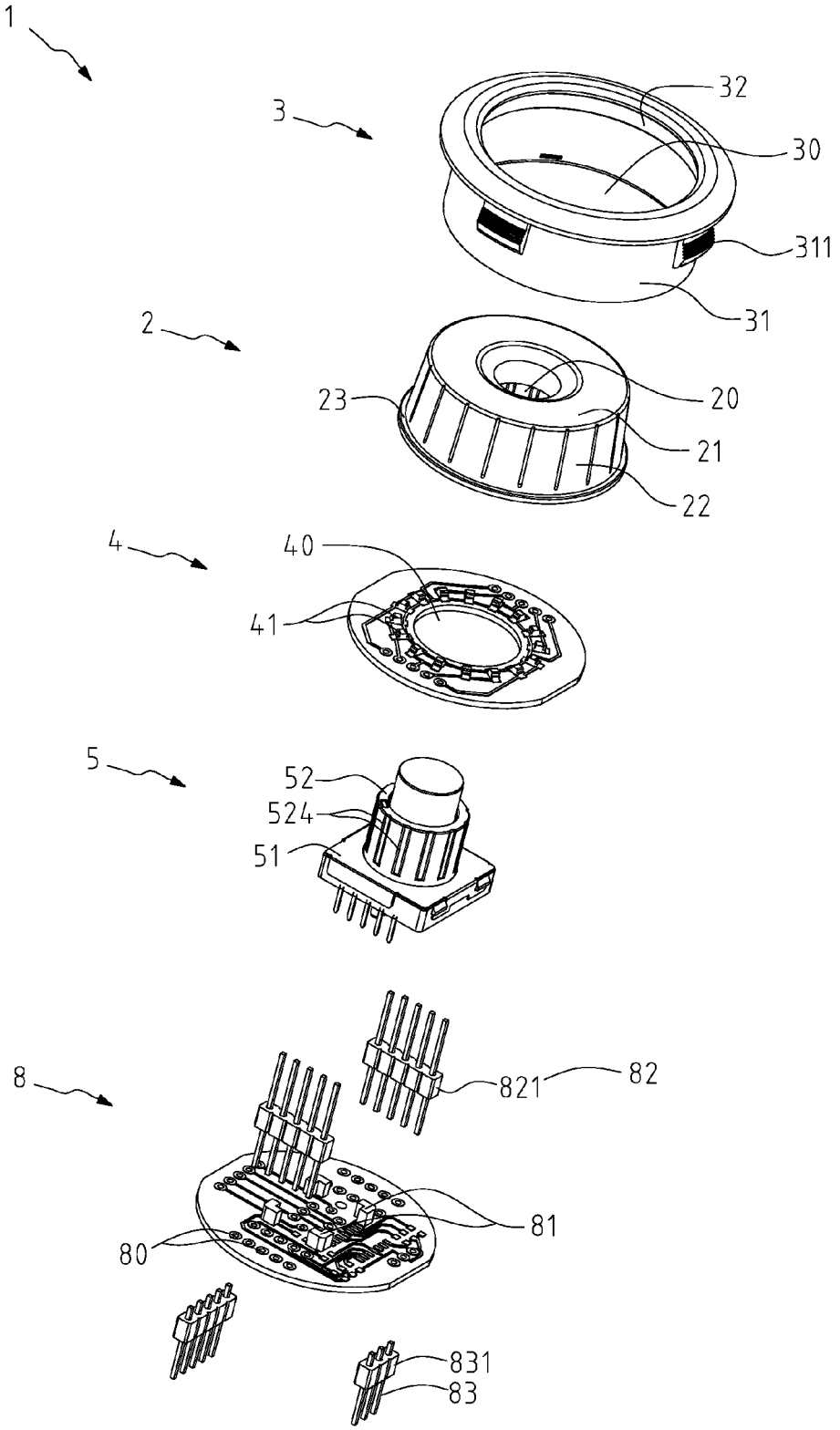
FIG. 1 is an exploded perspective view of a rotary encoder switch of the present invention.
Figure 2:
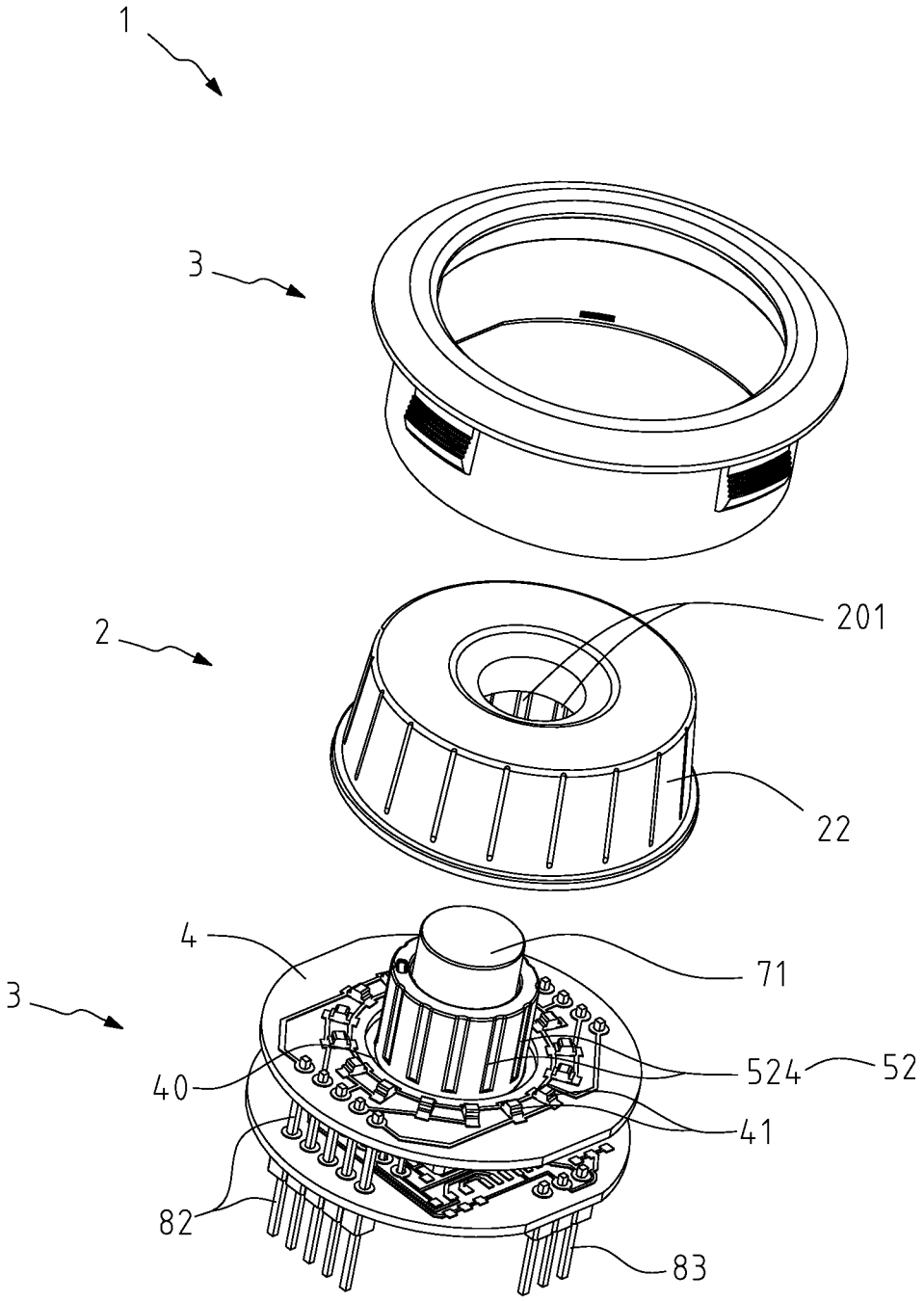
FIG. 2 is a partially assembly view of FIG. 1.

The second base board 8 is a printed circuit board and disposed under the actuating device 5 and has a plurality of terminal holes 80, conducting terminals 83 and connecting terminals 82. Each of the connecting terminals 82 penetrates respective terminal hole 80. The second base board 8 further has a plurality of pillars 81 arranged thereon for supporting the base seat 51 of the actuating device 5 in order to keep the second base board 8 away from the base seat 51 to ensure that the circuit on the second base board 8 is not affected by other components. Each of the conducting terminals 83 is coupled with a holding piece 831, and each of the connecting terminals 82 is coupled with a holding piece 821 in a middle portion thereof. The holding pieces 831 and 821 are used for holding the second base board 8 (as shown in FIG. 2). The connecting terminals 82 are intended to connect the first base board 4 and the second base board 8 to the printed circuit board of the applied product, and to electrically conduct the first lighting elements 41 with the printed circuit board of the applied product. The conducting terminals 83 are intended to electrically conduct the second base board 8 with the printed circuit board of the applied product so as to enable the actuating device 5 to work.

In use of the rotary encoder switch 1, the cover cap 2 is capable of being rotated to drive the rotary element 52 to rotate simultaneously due to the engagement of the engaging slots 524 and the engaging ribs 201. Accordingly, the contact element 54 under the rotary element 52 electrically contacts a plurality of signal terminals 53 (described below) in sequence so as to produce encoding signals according to rotation position of the cover cap 2 for controlling functions of the applied product, whereby the first lighting elements 41 are capable of emitting light which is permeable to display face 21 of the cover cap 2 in accordance with the rotation position and a rotation direction of the cover cap 2. For instance, based on practical application, each of the first lighting elements 41 is capable of emitting light one by one in sequence. Therefore, users can easily recognize the exact rotary position of the rotary element 2 from the lighting of the first lighting elements 41 so as to know which of stages of functions of the applied product is being reached.

Figure 7:
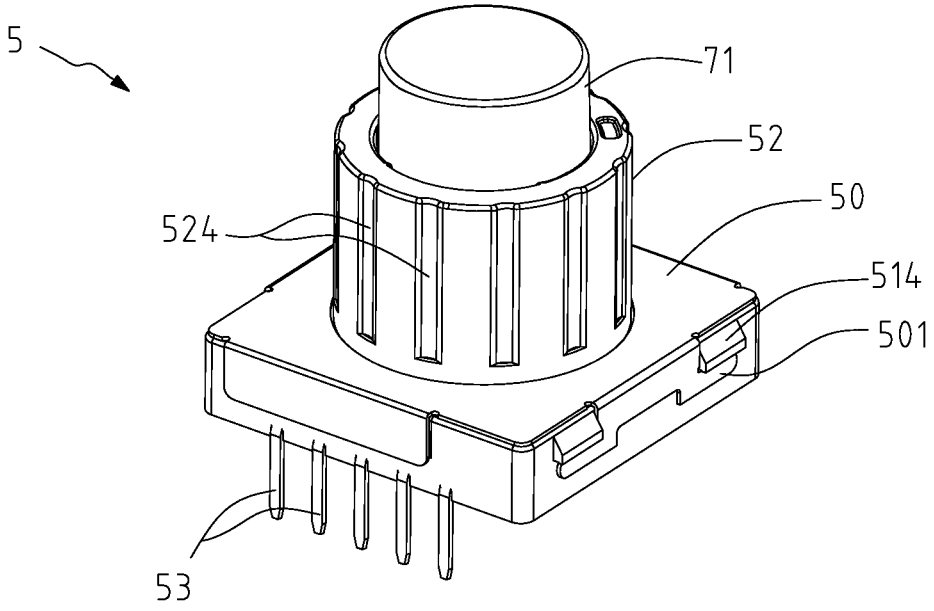
FIG. 7 is a perspective assembly view of FIG. 6.

Particularly note that the actuating device 5 of the present invention has an improved structure in positioning rotation of the rotary element 52. Referring to FIGS. 6 and 7, the base seat 51 of the actuating device 5 comprises a tube 511, at least a restraining portion 512, and a round track 510. The tube 511 has a round tubular shape and is hollow therein from a top to a bottom thereof. The tube 511 and the restraining portion 512 respectively extend upwards out of a surface of the base seat 51 and spaced apart from each other. The round track 510 is disposed around the tube 511 in between the tube 511 and the restraining portion 512, wherein the restraining portion 512 is disposed at a corner of the base seat 51 and has a restraining slot 513 formed in the restraining portion 512. One end of the restraining slot 513 communicates with the round track 510, and the restraining slot 513 is open widely at a top thereof for installation of the resilient element 6. Furthermore, two opposite sides of the base seat 51 are respectively provided with a protruding block 514, and two opposite sides of the shielding cover 50 are respectively provided with a fastening portion 501 for fastening the protruding block 514.

The rotary element 52 is pivotally mounted onto the tube 511. An interfering tooth portion 521 is formed on peripheral sides of a bottom of the rotary element 52 above the round track 510. The interfering tooth portion 521 has multiple tooth faces 522 and tooth grooves 523 formed between each two adjacent tooth faces 522. In the preferable embodiment, the multiple tooth faces 522 and the tooth grooves 523 cooperatively form a continuously curved face and are arranged on a same plane for facilitating the interference engagement with the resilient element 6. The rotary element 52 is located on the round track 510 and is pivotally rotatable about the tube 511 on the round track 510 in a clockwise direction or a counterclockwise direction.

Referring to FIG. 6, the plurality of signal terminals 53 are disposed under and around the base seat 51. One end of each of the signal terminals 53 extends out of the base seat 51 to form a soldering arm 532 to be soldered to the printed circuit board of the applied product. Another end of each signal terminal 53 is exposed to the round track 510 to form a bending arm 531. The contact element 54 is mounted to a bottom of the rotary element 52 between the plurality of signal terminals 53 and the base seat 51. The contact element 54, made of metal, comprises a plurality of contact arms 541 cooperatively forming a ring shape, wherein one end of each of the contact arms 541 is inclined so as to contact the bending arms 531 of the plurality of signal terminals 53.

As shown in FIG. 6, the shielding cover 50 is made of metal and is formed with a passing hole 500 that is mounted to the rotary element 52 in an upper direction of the base seat to a lower direction thereof for covering the interfering tooth portion 521 and the restraining portion 512. Each of the fastening portions 501 extends downwards and bends to form an L shape so as to fasten the respective protruding block 514.

As distinct from a traditional mechanical rotary switch, a product being used with the rotary encoder switch 1 of the present invention is allowed to accept a predetermined maximum power supply which is divided into a plurality of segment values as designed. For example, if an applied product is an electronic lighting device (not shown) which operates at a maximum power supply of 60 watt, then, based on a practical application, the maximum power supply of 60 watt can be divided into segment values. More specifically, one cycle of rotation of the rotary encoder switch 1 is defined to provide switches of 8 stages. Therefore, rotating one and one fourth cycles of the cover cap 2 is capable of reaching the maximum power supply for 10 stages. Accordingly, multistage switches of the rotary encoder switch 1 enable a decent performance of the electronic lighting device that the brightness can be changed in great gradation, or in another application the volume can be adjusted more precisely.

Particularly, the resilient element 6 comprises a spring 61 and an engaging head 62 which is made of metal and has an arc face. One end of the spring 61 is fixed in the restraining slot 513 of the base seat 51, and another end of the spring 61 props the engaging head against the interfering tooth portion 521 in a horizontal direction (as shown in FIGS. 8 and 9).

Figure 8:
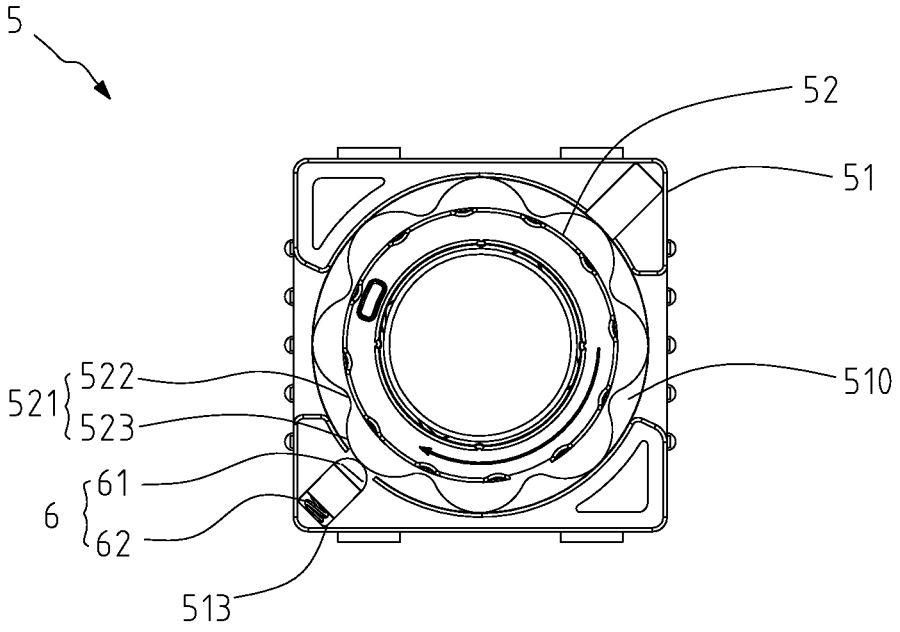
FIG. 8 is a schematic view showing an engagement of an resilient element and an interfering tooth portion of the present invention.
Figure 9:
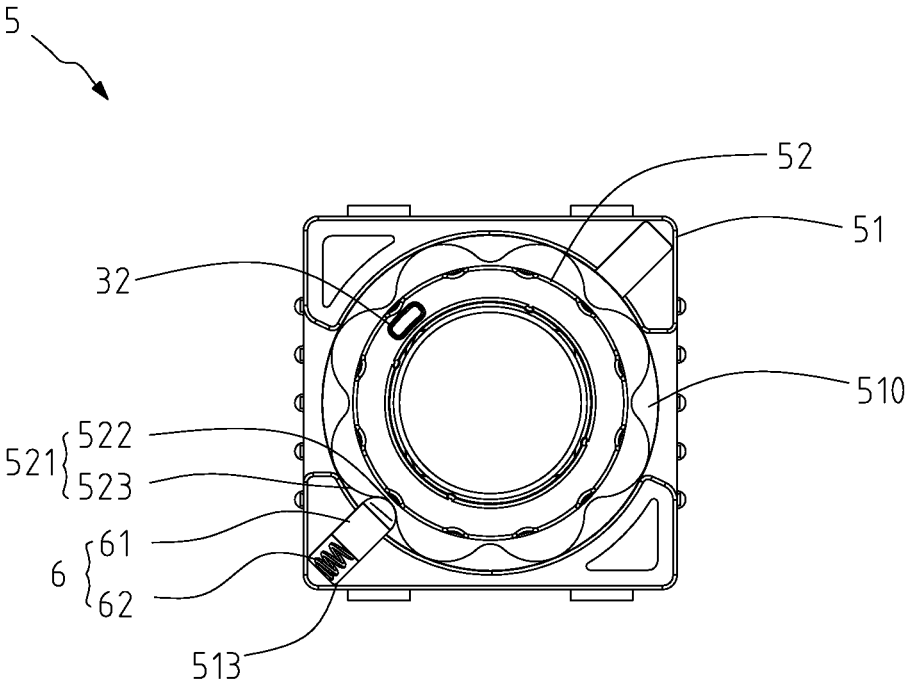
FIG. 9 is another schematic view showing the resilient element being engaged with and positioning the interfering tooth portion.

Referring to FIGS. 8 and 9 showing the operation of the actuating device 5, the rotary element 52 rotates in conjunction with the cover cap 2 on the round track 510, whereby the contact element 54 and the interfering tooth portion 521 are rotatably driven by the rotary element 52 to enable the plurality of contact arms 541 to electrically contact different portions of the signal terminals 53 so as to transmit electrical signals to the applied product and generate encoding signals. At the same time, the resilient element 6 is thus deformed and stretching backwards in conjunction with rotation of the interfering tooth portion 521; in other words, the engaging head 62 is constantly engaging with the multiple tooth faces 522 and tooth grooves 523 as the interfering tooth portion 521 being rotated, where the spring 61 is being depressed to move towards an inner portion of the restraining slot 513. When the rotary element 52 rotates in position, the spring 61 props the engaging head 62 against one of the tooth grooves 523.

As described above, the rotation of the rotary element 52 at each one of the tooth grooves 523 represents one of the segment values being reached. In a practical application, a clockwise rotation of the rotary element is defined to boost a power supply, while a counterclockwise rotation is defined to lower a power supply, wherein the rotary element 52 is capable of being continuously rotated multiple cycles to reach either one of the plurality of segment values.

Furthermore, the signals coded by the rotary encoder switch 1 is in a format of pulse width modulation (PWM) for activating the power supply or/and increasingly boosting a power supply of an external power source, or the signals being coded are intended to increasingly lower or deactivate the power supply. As a result, the rotary encoder switch 1 is capable of controlling an application product more precisely than a traditional mechanical rotary switch.

Figure 3:
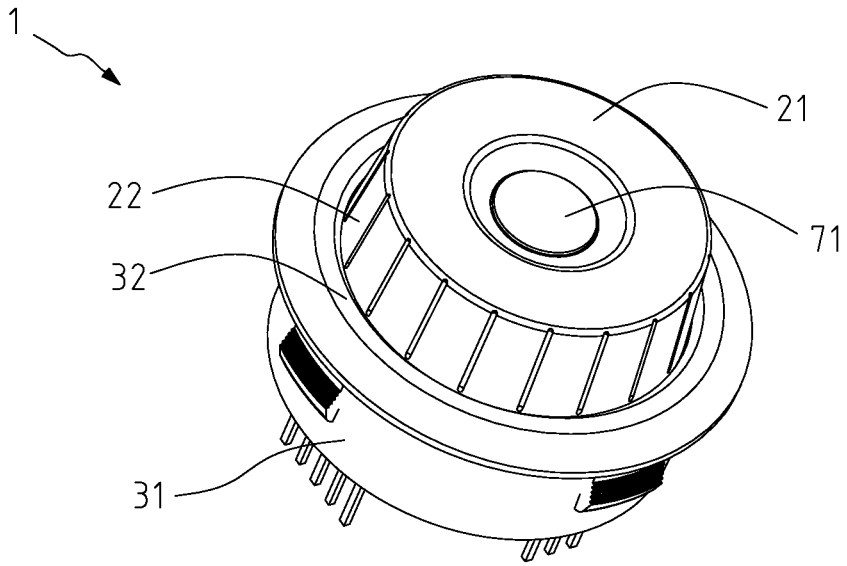
FIG. 3 is a perspective assembly view of FIG. 1.
Figure 4:
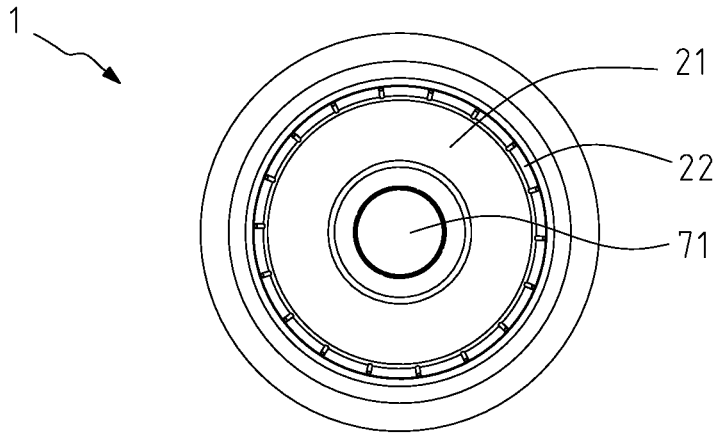
FIG. 4 is a top plan view of FIG. 3.

Referring to FIG. 6, the actuating device 5 further comprises a depressible apparatus 7 disposed in the tube 511. The depressible apparatus 7 comprises a supporting seat 72, a button 71 being light permeable and movably connected to the supporting seat 72 in the rotary element 52 and extending to the sleeve body 20 of the cover cap 2 for being depressed (as shown in FIG. 3), and at least a second lighting element 73 which is provided in the button 71 and is emitted at least by depressing the button 71. In this manner, from the light emitting of the second lighting element 73 users can know the status of whether the rotary encoder switch is switched on or off. Alternatively, the second lighting element 73 is capable of emitting different strength of light subject to rotation of the rotary element 52.

The rotary encoder switch 1 of the present invention utilizes the engagement of the resilient element 6 and the interfering tooth portion 521 of the rotary element 52 to position the rotation of the rotary element 52 driven by the cover cap 2, whereby effectively addressing the problem that a flexible plate of cantilever structure utilized in a traditional switch to position the rotary element tends to be damaged or disengaged after frequent use. Additionally, the maximum power supply to an applied product can be divided into a plurality of segment values by rotation of the cover cap 2, whereby generating an encoding signal which corresponds to a respective segment value according to each rotary position of the cover cap 2 or the rotary element 5. Therefore, the rotary encoder switch 1 is capable of reaching each one of the plurality of segment values by continuously rotating several cycles so as to enable a decent performance of an application product, whereby overcoming drawbacks of a traditional switch that is only capable of providing a limited number of switches and a poor performance. Furthermore, the first lighting elements 41 in cooperation with the cover cap 2 allows users to easily recognize where a rotary position is being reached.

It is understood that the invention may be embodied in other forms within the scope of the claims. Thus the present examples and embodiments are to be considered in all respects as illustrative, and not restrictive, of the invention defined by the claims.

What is claimed is:

1. A rotary encoder switch, comprising:

a cover cap made of light permeable material, comprising a display face, a covering wall extending downward from peripheral edges of the display face, and a sleeve body penetrating the display face to extend downward;

an actuating device comprising a base seat and a rotary element rotatably connected to the base seat and mounted into the sleeve body;

a first base hoard having a through hole and multiple first lighting elements arranged around the through hole and facing the display face of the cover cap, the rotary element passing through the through hole so that the through hole is located on the base seat;

a second base board disposed under the actuating device and having a plurality of terminal holes and conducting terminals electrically connected to a printed circuit board of an applied product; and a plurality of connecting terminals for connecting the first base board and the second base board, ends of the connecting terminals respectively passing through the plurality of terminal holes to electrically connect the printed circuit board of the applied product;

wherein the rotary element of the actuating device is rotatable in conjunction with rotation of the cover cap so as to produce encoding signals according to rotary positions of the cover cap for controlling functions of the applied product, whereby the first lighting elements are capable of emitting light which is permeable to the cover cap in accordance with one of the rotary positions and a rotation direction of the cover cap, and the base seat of the actuating device further comprises a tube, a restraining portion, and a round track, the tube and the restraining portion respectively protruding from an upper surface of the base seat and spaced apart from each other, the round track formed around the tube and in between the tube and the restraining portion, the rotary element rotatably mounted to the tube and comprising an interfering tooth portion formed on peripheral sides thereof and disposed on the round track; and wherein the actuating device further comprises:

a resilient element of which one end is coupled in the restraining portion, and another end extends out of the restraining portion in order to elastically engage the interfering tooth portion;

a shielding cover covering the interfering tooth portion and the restraining portion;

a plurality of signal terminals disposed under and arranged around a bottom of the base seat, one end of each of the signal terminals stretching out of the base seat to form a soldering arm for being soldered to the second base board;

a contact element provided under the base seat and above the plurality of signal terminals, and having multiple contact arms for electrically contacting the plurality of signal terminals; and a depressible apparatus disposed in the tube, and comprising a supporting seat, a button being light permeable and movably connected to the supporting seat in the rotary element and extending to the sleeve body of the cover cap for being depressed, and at least a second lighting element provided in the button and emitting light by depressing the button; wherein the rotary element is pivotally rotatable about the tube on the round track, and the contact element and the interfering tooth portion are capable of rotating in conjunction with the rotary element whereby enabling the contact arms of the contact element to electrically contact the plurality of signal terminals along the round track so as to generate electrical signals which are then transmitted to the printed circuit board for producing encoding signals, the resilient element being deformed and stretching backwards relative to rotation of the interfering tooth portion, and the resilient element returning to an original position to engage with the interfering tooth portion when the rotary element rotates in position.

2. The rotary encoder switch of claim 1, wherein the resilient element comprises a spring and an engaging head, one end of the spring fixed in the restraining portion of the base seat, another end of the spring propping against the engaging head, the engaging head being engageable with the interfering tooth portion, the interfering tooth portion having multiple tooth faces and tooth grooves arranged at a same plane, the engaging head being depressible to move towards an inner portion of the restraining portion in conjunction with the rotation of the interfering tooth portion, and when the rotary element rotates in place, the spring props the engaging head against one of the tooth grooves.

3. The rotary encoder switch of claim 1, wherein the sleeve body of the cover cap comprises multiple engaging ribs protruding from an inner surface thereof, and an outer surface of the rotary element is provided with multiple engaging slots corresponding to and being engageable with the engaging ribs.

4. The rotary encoder switch of claim 1, further comprising a fixing sleeve having a fixing wall, a mounting hole formed by the fixing wall, and an inner edge portion extending from a top of the fixing wall into the mounting hole, and a bottom of the covering wall of the cover cap extending outward radially to form a retaining rim being retained by the inner edge portion.

5. The rotary encoder switch of claim 1, wherein the second base board further has a plurality of pillars for supporting the base seat of the actuating device, and each of the conducting terminals and the connecting terminals is coupled with a holding piece for holding the second base board.

6. A rotary encoder switch, comprising:

a base seat comprising a tube, a restraining portion, and a round track, the tube and the restraining portion respectively protruding from an upper surface of the base seat and spaced apart from each other, the round track formed around the tube and in between the tube and the restraining portion;

a rotary element rotatably mounted to the tube and comprising an interfering tooth portion formed on peripheral sides thereof and disposed on the round track;

a resilient element of which one end is coupled in the restraining portion, and another end extends out of the restraining portion and elastically engages the interfering tooth portion;

a shielding cover covering the interfering tooth portion and the restraining portion;

a plurality of signal terminals disposed under and arranged around a bottom of the base seat, one end of each of the signal terminals stretching out of the base seat to form a soldering arm;

a contact element provided under the base seat and above the plurality of signal terminals, and having multiple contact arms, the multiple contact arms cooperatively forming a ring shape, one end of each of the contact arms being inclined to electrically contact the plurality of signal terminals; and a depressible apparatus disposed in the tube, and comprising a supporting seat, a button being light permeable and movably connected to the supporting seat in the rotary element for being depressed, and at least a lighting element provided in the button;

wherein the rotary element is pivotally rotatable about the tube on the round track, and the contact element and the interfering tooth portion are capable of rotating in conjunction with the rotary element whereby enabling the contact arms of the contact element to electrically contact the plurality of signal terminals along the round track so as to generate electrical signals which are transmitted to the printed circuit board for producing encoding signals, the resilient element being deformed and stretching backwards relative to rotation of the interfering tooth portion, and the resilient element returning to an original position to engage with the interfering tooth portion after the rotary element rotates to a predetermined position, and wherein the resilient element comprises a spring and an engaging head, one end of the spring fixed in the restraining portion of the base seat, another end of the spring propping against the engaging head, the engaging head being engageable with the interfering tooth portion, the interfering tooth portion having multiple tooth faces and tooth grooves arranged at a same plane, the engaging head being depressible to move towards an inner portion of the restraining portion in conjunction with the rotation of the interfering tooth portion, and when the rotary element rotates in place, the spring props the engaging head against one of the tooth grooves.

* * * * *